US005212962A

United States Patent [19]

Kang et al.

[11] Patent Number: 5,212,962

[45] Date of Patent: May 25, 1993

[54] VEGETABLE BOX COOLING APPARATUS FOR REFRIGERATOR

[75] Inventors: Sung-Chel Kang; Kyong-Man Kim, both of Suwon, Rep. of Korea

[73] Assignee: Samsung Electronics Co., Ltd., Suweon, Rep. of Korea

[21] Appl. No.: 814,705

[22] Filed: Dec. 30, 1991

[30] Foreign Application Priority Data

Jan. 7, 1991 [KR] Rep. of Korea ..... 91-120

[51] Int. Cl.[5] ..... F25D 25/02

[52] U.S. Cl. ..... 62/382; 621/441; 312/402

[58] Field of Search ..... 62/382, 441; 312/402

[56] References Cited

U.S. PATENT DOCUMENTS

| | | | |
|---|---|---|---|
| 4,326,390 | 4/1982 | Brooks | 62/382 |
| 4,488,412 | 12/1984 | Weaver et al. | 62/382 |
| 4,722,200 | 2/1988 | Frohbieter | 62/382 |
| 4,732,014 | 3/1988 | Frohbieter | 62/382 |
| 5,095,717 | 3/1992 | Germi | 62/382 |

FOREIGN PATENT DOCUMENTS

| | | |
|---|---|---|
| 55-8805 | 1/1980 | Japan . |
| 1-91871 | 6/1989 | Japan . |
| 90/7062 | 4/1990 | Rep. of Korea . |

*Primary Examiner*—Ronald C. Capossela
*Attorney, Agent, or Firm*—Burns, Doane, Swecker & Mathis

[57] ABSTRACT

A refrigerator includes a refrigerating room, a vegetable room, and a vegetable box movably disposed in the vegetable room. The vegetable box includes an air inlet and an air outlet. A duct disposed on a wall of the vegetable box interconnects the air inlet and air outlet. A blower disposed in the duct circulates air from said outlet to said inlet. The duct carries seals which form air seals around the inlet and outlet when the vegetable box is closed. Temperature sensors automatically turn the blower on and off. A channel extends along a wall of the vegetable box and includes through-holes. The channel communicates with the air outlet.

6 Claims, 3 Drawing Sheets

FIG. 1
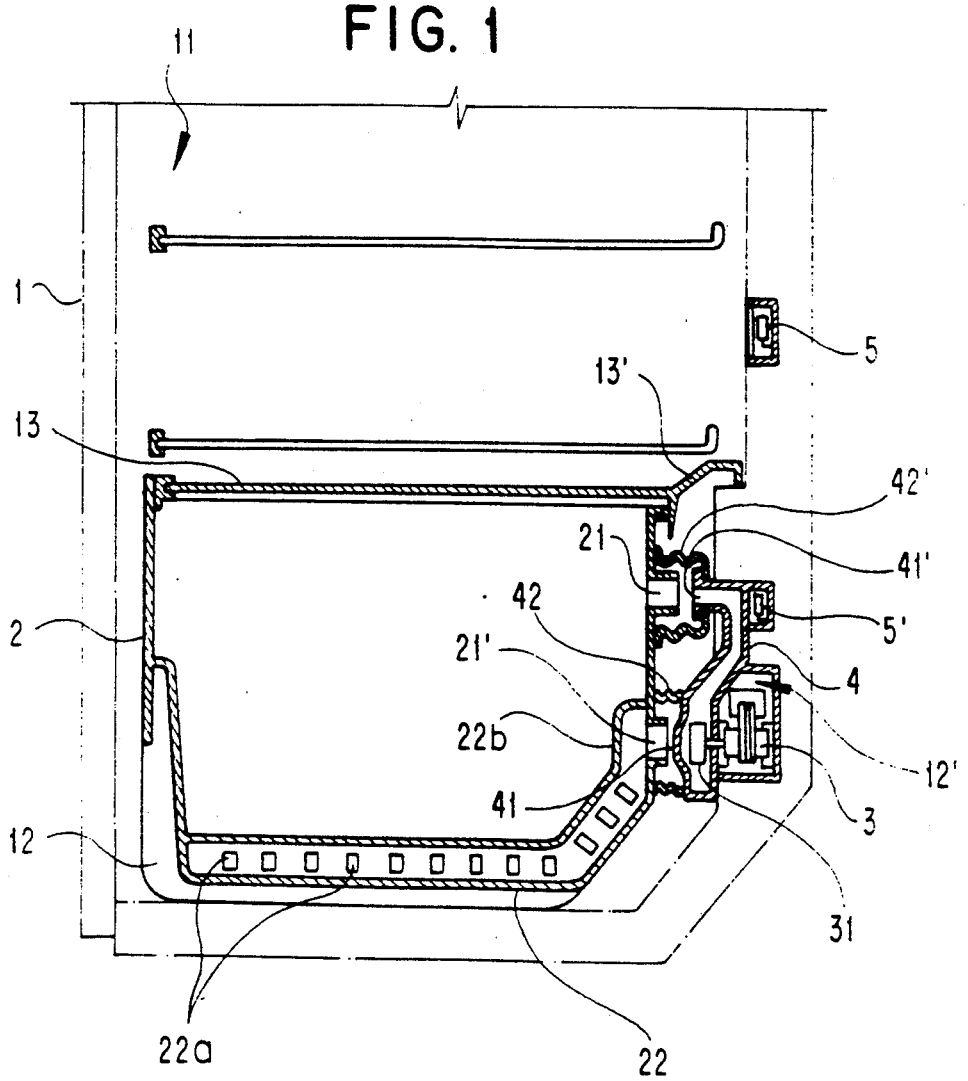
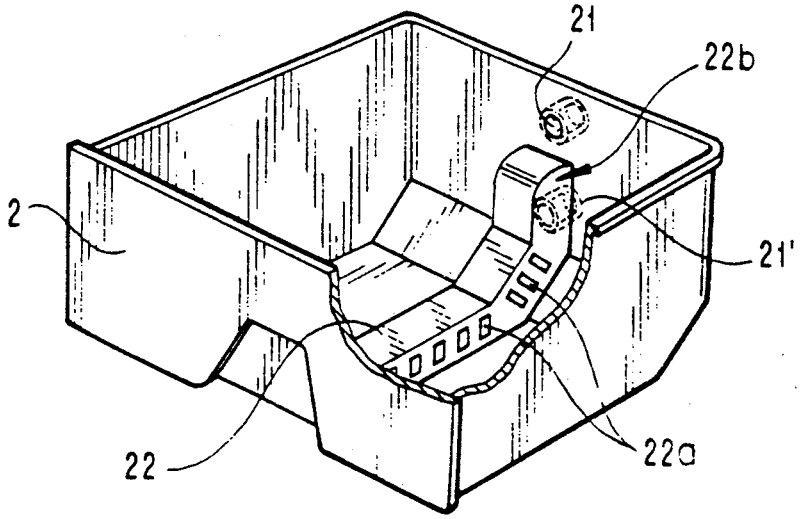
FIG. 2

VEGETABLE BOX COOLING APPARATUS FOR REFRIGERATOR

FIELD OF THE INVENTION

The present invention relates to a refrigerator, and particularly to a vegetable box cooling apparatus for a refrigerator, in which the cool air within the vegetable box is forcibly circulated, thereby speedily and uniformly cooling the vegetables within the vegetable box, and making it possible to store the vegetables in a fresh state for a long time.

BACKGROUND OF THE INVENTION

In most conventional refrigerators as shown in FIG. 5, the cool air which is introduced into a refrigerating room 11 is circulated within a vegetable room 12 by means of a blowing fan 10 so that a vegetable box 20 is indirectly cooled. Such a method of cooling is not very effective, and, in an attempt to give a solution to this problem, there was proposed another vegetable box cooling apparatus. This apparatus is proposed in Korean Utility Model Laid-Open No. 90-7062, and is constituted as described below. That is, a projected front portion with a plurality of cool air passing holes formed thereon is provided on a frontal plate of the vegetable box, and an upper flange portion is formed vertically relative to the projected front portion and integrally with it. Further, a plurality of engaging protuberances are projected in the horizontal direction from the outer surface of the upper flange portion, while a gasket of a proper shape is installed on the upper flange portion, thereby making the cool air within the refrigerating room smoothly circulate around the vegetable box.

Meanwhile, Japanese Utility Model Laid-Open No. 55-8805 discloses another vegetable box cooling apparatus. In this apparatus, a part of the cool air which is supplied into the refrigerating room is introduced through a cooling duct installed on the wall of the vegetable room into the vegetable room. Further, still another apparatus is disclosed in Japanese Utility Model Laid Open No. 1-91871. In this apparatus, a temperature sensor is installed on the vegetable box, and a damper which is selectively opened or closed by control signal transmitted from a controller (not shown) is installed on a vegetable box passage which is formed around the vegetable box, so that the damper should be able to selectively supply or cut off the cool air to and from the vegetable room or the vegetable room passage.

In the above described conventional apparatuses, the vegetable room and the vegetable box are almost sealingly divided , and the vegetables within the vegetable box are indirectly cooled through the surrounding walls of the vegetable box, with the result that there occurs temperature difference between the vegetable room and the vegetable box. Particularly, in the initial operating stage of the refrigerator, the cooling speed of the vegetable box is very slow, and therefore, speedy cooling of vegetables becomes difficult. Further, during the operation after the initial operating stage of the refrigerator, the internal temperature of the vegetable box is maintained higher than that of the vegetable room, with the result that the stored vegetables are severely dried or degenerated, thereby making it impossible to store vegetables in a fresh state for a long time.

SUMMARY OF INVENTION

The present invention is intended to overcome the above described disadvantages.

Therefore it is an object of the present invention to provide a vegetable box cooling apparatus for refrigerator, in which the cool air within the vegetable box is forcibly circulated, so that the stored vegetables can be speedily cooled by improving the thermal transfer efficiency, and that it should be made possible to store vegetables in a fresh state for a long time by maintaining the internal temperature of the vegetable box within a certain temperature range.

In achieving the above object, the vegetable box cooling apparatus according to the present invention comprises a refrigerator body including a freezing room, a refrigerating room, and a vegetable room partitioned from each other, and provided with a blowing fan in order to circulate the cool air;

a vegetable box pivotally installed within the vegetable room so as for vegetables to be stored, and having a cool air inlet and a cool air outlet;

a cool air sucking member curvedly formed on and across the bottom of the vegetable box and integrally with it, and connected to the cool air outlet of the vegetable box so as for the cool air of the interior of the vegetable box to be sucked thereinto;

a cool air circulating member installed on a recess of the rear wall of the vegetable room, and provided with a fan motor and a blower enabling cool air to be circulated;

a duct member for receiving the blower, and for connecting the cool air inlet and the cool air outlet; and first and second temperature sensing means for sensing the temperatures of the refrigerating room and the vegetable room in order to transmit control signals to a controller to enable the cool air circulating member to be turned on and off.

During the operation of the apparatus of the present invention constituted as described above, if the internal temperatures of the refrigerating room and the vegetable room reach pre-set levels by the help of the functions of the first and second temperature sensing means, then the cool air circulating member is turned on by a controller (not shown). At the same time, the cool air of the refrigerating room is forcibly circulated through a duct member and the cool air sucking member (installed within the vegetable box), thereby improving the heat transfer efficiency within the vegetable box, and making it possible to speedily cool the vegetables. Further, the internal temperature of the vegetable box can be maintained within a predetermined temperature range which is almost the same as the temperature of the refrigerating room, thereby making it possible to store vegetables in a fresh state for a long time.

BRIEF DESCRIPTION OF THE DRAWINGS

The above object and other advantages of the present invention will become more apparent by describing in detail the preferred embodiment of the present invention with reference to the attached drawings in which:

FIG. 1 is a schematic sectional side view showing the lower structure of the refrigerator adopted for the present invention;

FIG. 2 is a partly cut-out perspective view of the vegetable box according to the present invention;

FIG. 4 graphically illustrates comparisons of the temperature of the vegetable box of the present invention with that of the conventional refrigerator, in which:

DESCRIPTION OF THE PREFERRED EMBODIMENT

Figure 3:
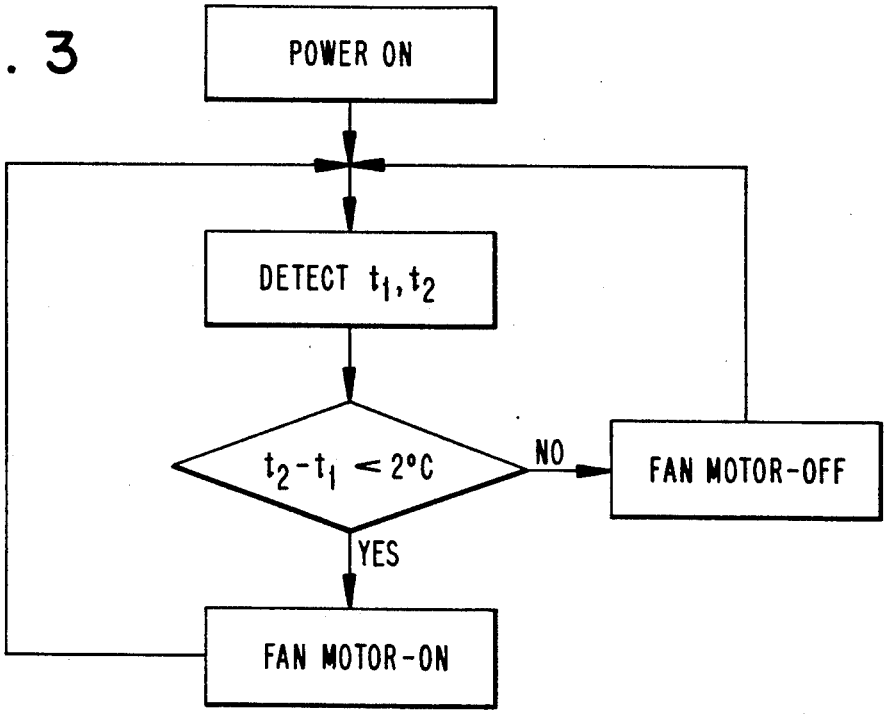
FIG. 3 illustrates the operating system of the fan motor according to the present invention.

FIGS. 1 and 2 illustrate an embodiment of the present invention, and as shown in these drawings, a vegetable room 12 is formed in the lower portion of a refrigerating room 11 of a refrigerator body 1. A vegetable box 2 is pivotally installed in a sealed state within the vegetable room 12, and the refrigerating room 11 and the vegetable room 12 are isolated from each other by means of a partition 13, while an opening 13' is formed on the rear end of the partition 13 so as for the cool air to be supplied from the refrigerating room 11 toward the vegetable room 12. The cool air which is introduced through opening 13, is circulated through the vegetable room 12, and then, the cool air returns through the front portion into the refrigerating room 11. Through the repetitions of such cycles, the vegetable box 2 is indirectly cooled.

About the middle of the rear wall of the vegetable box 2, there are formed a cool air inlet 21 and a cool air outlet 21, separated vertically from each other. Further, a cool air sucking member, or channel 22 provided with a plurality of through-holes 22*a* on the opposite walls thereof is integrally formed across the bottom of the vegetable box 2, with a rear end 22*b* of the cool air sucking member 22 being connected to the cool air outlet 21', so that the cool air sucking member 22 should be able to suck the cool air within the vegetable box 2 and discharge it through the cool air outlet 21'.

Further, a recess 12' is formed at a proper position on the rear wall of the vegetable room 12' and a blower 31 is installed in the recess 12', so that the blower 31 should be able to forcibly circulate the cool air upon being rotated by a fan motor 3. In front of the recess 12', there is installed a duct 4 for receiving the blower 31. A suction hole 41 which is led to the cool air outlet 21' of the vegetable box 2 is formed at the lower end of the duct 4, while a discharge hole 41' which is led to the cool air inlet 21 of the vegetable box 2 is formed at the upper end of the duct 4. Further, corrugated tubes 42, 42' which are contractable and extendable are connected between the cool air outlet 21' and the suction hole 41' and between the cool air inlet 21 and the discharge hole 41' respectively in order to connect them in an air-tight state.

Meanwhile, a first temperature sensor 5 which is for sensing the internal temperature t1 of the refrigeration room 11 is installed at a proper position on the rear wall of the refrigerating room 11, while a second sensor 5' which is for sensing the internal temperature of the duct 4, i.e., the internal temperature t2 of the vegetable box 2 is installed at a proper position on the upper portion of the duct 4. As shown in FIG. 4, these first and second temperature sensors 5,5' detect the temperature t1 of the refrigerating room 11 and the temperature t2 of the vegetable box 2 respectively in order to output sensing signals to a controller (not shown). Thus if the controller (not shown) finds that the difference (t2-t1) between the temperatures t1 and t2 reaches a certain pre-set value, the controller (not shown) outputs a control signal in order to activate the fan motor 3, so that the internal air of the vegetable box 2 should be circulated by the blower 31.

The apparatus of the present invention constituted as above will now be described as to its operations and effects.

As shown in FIG. 3, the first and second temperature sensors 5,5' detect the internal temperature t1 of the refrigerating room 11 and the internal temperature t2 of the vegetable box 2, i.e., the internal temperature of the duct 4 respectively in order to output sensing signals to the controller (not shown). Under this condition, if the difference (t2-t1) between the temperatures t1,t2 reaches a certain pre-set value, i.e., 2° C. in the present embodiment, a control signal is outputted from the controller (not shown) in order to drive the fan motor 3, so that the blower 31 should be activated in order to circulate the internal air of the duct 4.

Owing to the pressure difference generated by the operation of the blower 31, the internal air of the vegetable box 2 is sucked through the through-hole 22*a* of the air sucking member 22 into the duct 4, and then, introduced through the cool air outlet 21' and the suction hole 41 of the duct 4 into the interior of the duct 4. Then the air is returned through the discharge hole 41' and the cool air inlet 21 into the vegetable box 2, thereby forcibly circulating the air within a closed circuit. Therefore, a heat transfer, is carried out in the form of conduction and natural convection through a thermal boundary layer formed on the interior and exterior surfaces of the walls of the partition 13 or the vegetable box 2. The cool boundary air is allowed to continuously flow in a forcible manner into the circulating air toward the cool air sucking member 22, with the result that the heat transfer efficiency is improved during the heat transfer through the thermal boundary layer.

Figures 4A, 4B, 4C:
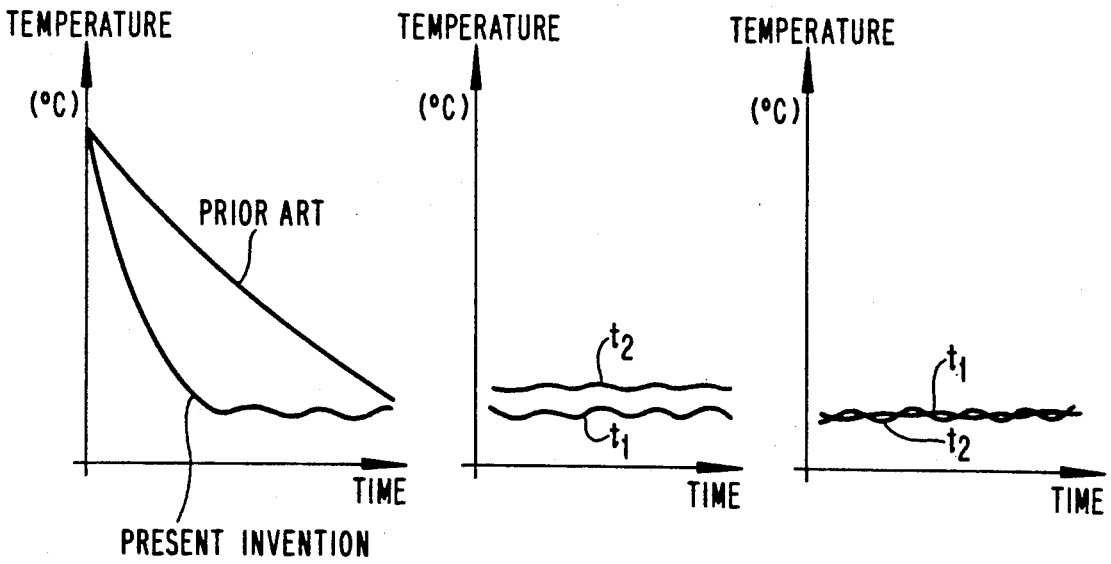
FIG. 4(a) FIG. 4(b) (PRIOR ART) FIG. 4(c)
FIG. 4*a* graphically illustrates the temperature variation of the vegetable room at the initial operating stage.
FIG. 4*b* graphically illustrates the temperature variations of the vegetable room and the refrigerating room during the operation of the conventional refrigerator.
FIG. 4*c* graphically illustrates the temperature variations of the vegetable room and the refrigerating room during the operation of the refrigerator according to the present invention.
Figure 5:
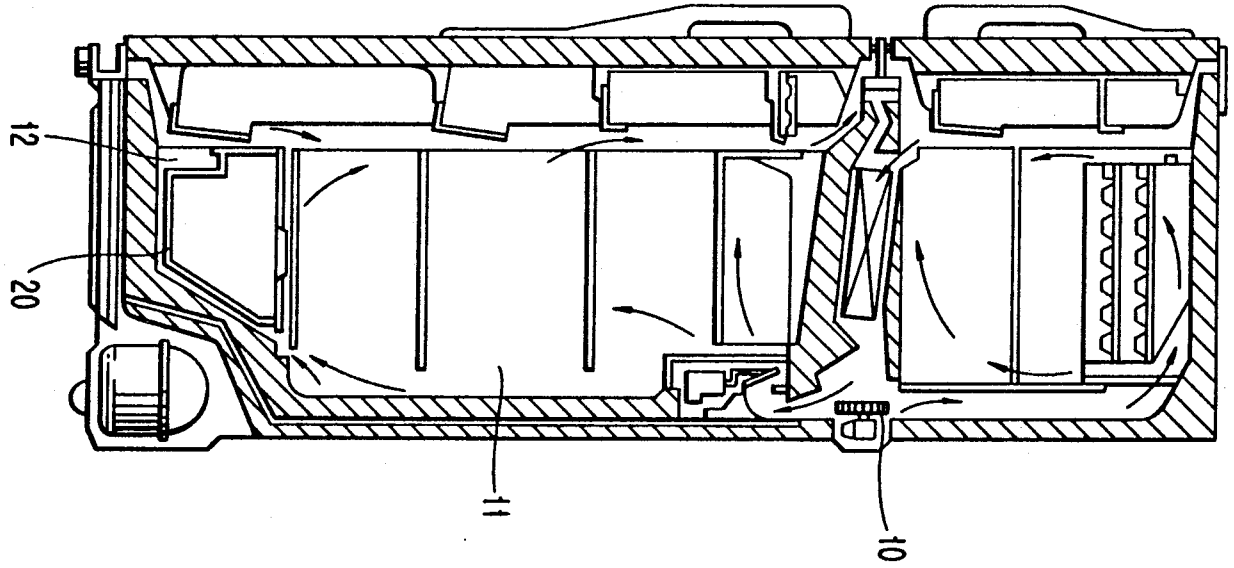
FIG. 5 (PRIOR ART)
FIG. 5 is a schematic sectional side view of the conventional refrigerator.

Therefore the rate of the heat transfer to the vegetable box 2 is increased, and, the internal temperature t2 of the vegetable box 2 is speedily lowered compared with the case of the conventional refrigerators as shown in FIG. 4*a*, thereby cooling vegetables very speedily. Under this condition, if the temperature difference (t2-t1) shows to be less than 2° C., then a control signal is outputted from the controller (not shown) in accordance with the sensing signals from the first and second temperature sensors 5,5' in order to stop the driving of the fan motor 3, so that the driving of the blower 31 should be terminated.

Meanwhile, if the temperature difference (t2-t1) is 2° C. or more, then the blower 31 is activated in the above described manner in order to forcibly circulate the internal cool air of the vegetable box 2 continuously, so that the internal temperature t1 of the refrigerating room 11 or the vegetable room 12 and the internal temperature t2 of the vegetable box 2 can be maintained within a certain range. That is, as shown in FIG. 4*c*, a cooling operation can be carried out in such a manner that there should be almost no temperature difference between the temperature t1 of the refrigerating room 11 and the internal temperature t2 of the vegetable box 2, thereby achieving a uniform cooling.

According to the present invention as described above, the internal cool air of the vegetable box is forcibly circulated, so that the heat transfer from the refrigerating room or the vegetable room into the vegetable box should be enhanced, thereby making it possible to speedily cool vegetables. Further, owing to the forced circulation of the cool air, the internal temperature of the vegetable box can be maintained at almost the same level as that of the refrigerating room or the vegetable room, so that vegetable should not be easily dried or degenerated, thereby making it possible to store vegetables in a fresh state for a long time.

What is claimed is :

1. A vegetable box cooling apparatus for refrigerator, comprising:

a refrigerator body partitioned into a freezing room, refrigerating room, and a vegetable room and provided with a blowing fan for circulating cool air;

a vegetable box movably disposed within said vegetable room in such a manner as to store vegetables, and provided with a cool air inlet and a cool air outlet on the rear wall thereof;

a cool air sucking member integrally and curvedly formed across the bottom of said vegetable box, with one of its ends being connected to said cool air outlet order to suck the cool air within said vegetable box;

a cool air circulating member installed within a recess formed on the rear wall of said vegetable room, and provided with a fan motor and a blower in order to circulate the cool air;

a duct member for accommodating said blower, and connected between said cool air inlet and said cool air outlet of said vegetable box ; and first and second temperature sensing means for detecting the temperatures of said refrigerating room and said vegetable room, and for outputting sensing signals to a controller in order to turn on or off said cool air circulating member.

2. The vegetable box cooling apparatus for refrigerator as claimed in claim 1, wherein said cool air sucking member is provided with a plurality of through-holes for sucking the internal cool air of said vegetable box.

3. The vegetable box cooling apparatus for refrigerator as claimed in claim 1, further comprising corrugated extendable and contractable tubes for sealing up the passages between said cool air inlet and a discharge hole of said duct member, between said cool air outlet and a suction hole of said duct member.

4. The vegetable box cooling apparatus for refrigerator as claimed in claim 1, wherein a driving signal is outputted from said controller in order to drive said fan motor, if the temperature difference between the temperature of said refrigerating room and the temperature of said vegetable box is 2° C. or more.

5. A refrigerator comprising:

a refrigerating room and a vegetable room;

a first blower for circulating cool air within said refrigerating room;

a vegetable box movably disposed within said vegetable room and slidable between open and closed states, said box including a rear wall having an air outlet and an air inlet;

a duct disposed on a forwardly facing wall defining said vegetable room and interconnecting said air outlet and air inlet;

a second blower mounted in said duct for sucking air out of said vegetable box through said air outlet and introducing the air back into said vegetable box through said air inlet; and first and second seal mans mounted on one of said forwardly facing wall and said rear wall and positioned to form air seals completely surrounding said air inlet and air outlet, respectively, when said vegetable box is in said closed state.

6. A refrigerator comprising:

a refrigerating room and a vegetable room;

a first blower for circulating cool air within said refrigerating room;

a vegetable box having front and rear ends and being disposed for forward and rearward sliding movement within said vegetable room, said vegetable box including an air outlet and an air inlet;

a duct interconnecting said air outlet and air inlet;

a second blower for sucking air out of said vegetable box through said air outlet and introducing the air back into said vegetable box through said air inlet; and a channel disposed along a wall of said vegetable box and including through-holes communicating with the inside of said vegetable box, said through-holes spaced apart in a front-to-rear direction, said channel communicating with said air outlet so that said second blower sucks air from said vegetable box through said through-holes.

* * * * *